US011212602B2

(12) United States Patent
Chen et al.

(10) Patent No.: US 11,212,602 B2
(45) Date of Patent: Dec. 28, 2021

(54) SCREEN SOUNDING DEVICE

(71) Applicant: AAC Technologies Pte. Ltd., Singapore (SG)

(72) Inventors: Zhaoxian Chen, Shenzhen (CN); Lubin Mao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/992,117

(22) Filed: Aug. 13, 2020

(65) Prior Publication Data

US 2021/0006877 A1 Jan. 7, 2021

Related U.S. Application Data

(63) Continuation of application No. PCT/CN2019/092838, filed on Jun. 25, 2019.

(30) Foreign Application Priority Data

Jun. 12, 2019 (CN) ..... 201910506255.8

(51) Int. Cl.

| | |
|---|---|
| ***H04R 1/02*** | (2006.01) |
| ***H04R 9/02*** | (2006.01) |
| ***H04R 9/04*** | (2006.01) |

(52) U.S. Cl.

CPC ..... *H04R 1/023* (2013.01); *H04R 9/025* (2013.01); *H04R 9/046* (2013.01)

(58) Field of Classification Search

CPC ..... H04R 13/00; H04R 2499/11; H04R 2499/15; H04R 9/025; H04R 9/06; H04R 1/023; H04R 1/2834

See application file for complete search history.

(56) References Cited

U.S. PATENT DOCUMENTS

2012/0243719 A1* 9/2012 Franklin ..... H04R 1/02 381/333

2014/0185859 A1* 7/2014 Wilk ..... H04R 9/025 381/412

* cited by examiner

*Primary Examiner* — Sunita Joshi

(74) *Attorney, Agent, or Firm* — W&G Law Group

(57) ABSTRACT

The invention provides a screen sounding device, including a frame; a screen installed on the frame; and a driving device arranged between the frame and the screen for driving the screen to generate sound. The driving device includes a magnetic circuit system fixed on the screen and an electromagnet for driving the magnetic circuit system. The magnetic circuit system includes a connection covering plate fixed on the screen and a magnet fixed on a side of the connection covering plate away from one of the screen, and the magnet is arranged around the electromagnet. By virtue of the configuration, the driving force is greater and the sound performance is improved.

7 Claims, 10 Drawing Sheets

A-A

SCREEN SOUNDING DEVICE

FIELD OF THE PRESENT DISCLOSURE

The present disclosure relates to the technology filed of mobile terminals, especially to a screen sounding device equipped with a mobile terminal.

DESCRIPTION OF RELATED ART

In a mobile terminal of the related technology, generally a structure design of piezoelectric type or moving coil type is adopted for a driving unit which drives the screen to generate sound. The driving unit is arranged inside the whole machine of the mobile terminal. The whole component or distributed component connects a middle frame of the mobile terminal (or rear covering plate) and the screen of the mobile terminal, and drives the screen to vibrate and sound through piezoelectric type or a driving device of a moving coil. But, the driving device of piezoelectric type needs larger voltage and high energy consumption, however a driving device of the moving coil type is very limited.

Therefore, it is necessary to provide an improved screen sounding device with lower energy consumption and larger driving force.

SUMMARY OF THEN INVENTION

One of the major objects of the present invention is to provide a screen sounding device with greater driving force to generate improved sound performance.

In order to achieve the object mentioned above, the invention provides a screen sounding device, including a frame; a screen installed on the frame; and a driving device arranged between the frame and the screen for driving the screen to generate sound. The driving device includes a magnetic circuit system fixed on the screen and an electromagnet for driving the magnetic circuit system. The magnetic circuit system includes a connection covering plate fixed on the screen and a magnet fixed on a side of the connection covering plate away from one of the screen, and the magnet is arranged around the electromagnet. By virtue of the configuration, the driving force is greater and the sound performance is improved.

As an improvement, the electromagnet includes an iron core, a coil wound around the iron core, an upper magnetic covering plate arranged on a side of the iron core close to the screen, and a lower magnetic covering plate arranged on a side of the iron core away from the screen; the lower magnetic covering plate is fixed on the frame.

As an improvement, the screen sounding device further includes a plurality of magnets distributed evenly around the electromagnet.

As an improvement, the magnet is an integrally-made ring.

As an improvement, the magnet is magnetized along a vibration direction of the screen.

As an improvement, the magnetic circuit system further includes a magnet conduction plate connected on one side of the magnet away from the screen.

As an improvement, the connection covering plate is made by magnetic conduction material.

As an improvement, the frame includes a middle frame and a rear covering plate covered on a side of the middle frame opposite to the screen; the screen and the rear covering plate form a first accommodation cavity and a second accommodation cavity separately with the middle frame; the driving device is accommodated inside the first accommodation cavity and the electromagnet is fixed with the middle frame.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
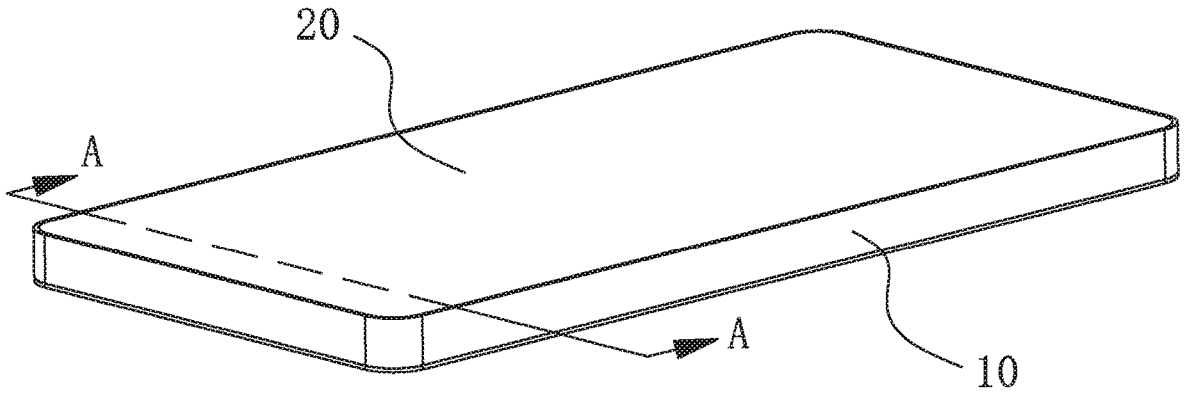
FIG. 1 is an exploded view of a screen sounding device in accordance with a first embodiment of the present invention.
Figure 2:
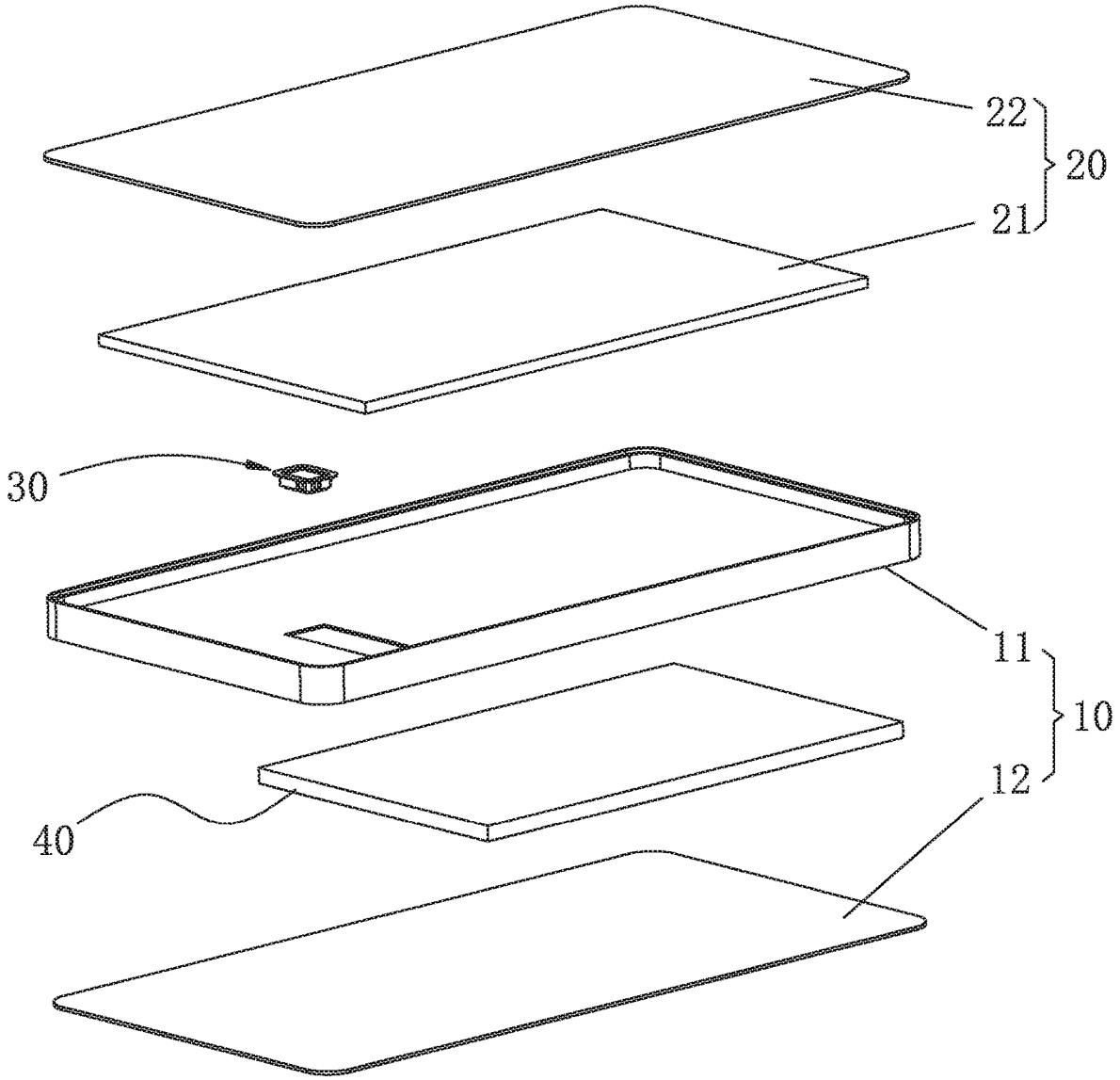
FIG. 2 is an exploded view of the screen sounding device in FIG. 1.

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

As shown in FIGS. 1-7, a screen sounding device of a first embodiment of the invention is disclosed. In the first embodiment, the screen sounding device includes a frame 10, a screen 20 installed on the frame 10 and a driving device 30 arranged between the frame 10 and the screen 20 for driving the screen 20 to vibrate for generating sound. The driving device 30 includes a magnetic circuit system 31 fixed on the screen 20 and an electromagnet 32 fixed on the frame 10 for driving the magnetic circuit system 31 to vibrate. In the embodiment, the magnetic circuit system 31 includes a connection covering plate 311 fixed on the screen 20 and a magnet 312 fixed on a side of the connection covering plate 311 away from the screen 20, and the magnet 312 is arranged around the electromagnet 32.

The screen sounding device provided in the invention adopts a structural design of electromagnet type which drives the screen 20 to vibrate and sound. When electrified, the electromagnet 32 interacts with the magnetic circuit system 31 and drives the magnetic circuit system 31 to vibrate and drive the screen 20 to vibrate further for generating sound. Comparing with the structural design of the driving device of piezoelectric type adopted in the related technology, the magnetic circuit system 31 in electromagnetic driving method in the invention interacts with the electromagnet 32 and provides adequate stronger driving force with small energy consumption to obtain better sounding effect. In addition, the invention adopts the structural design of electromagnet type for driving the screen 20 to vibrate and sound, comparing with a speaker\receiver adopted in the traditional technology, the invention omits the diaphragm structure of the traditional sound generator, which reduces the cost of manufacturing such a device.

Specifically, the electromagnet 32 of a first embodiment includes an iron core 321, a coil 322 wound around the iron core 321, an upper magnetic covering plate 323 arranged on one side of the iron core 321 being close to the screen 20, and a lower magnetic covering plate 324 arranged on one side of the iron core 321 being away from the screen 20. The lower magnetic covering plate 324 is fixed on the frame 10 (preferably, the lower magnetic covering plate 324 is connected inside the frame 10 by adopting the method of bonding and fixation). When electrified, the coil 322 cooperates with the iron core 321 to generate magnetic flux. During the process of work, the electromagnet 32 interacts with the magnetic circuit system 31 and drives the magnetic circuit system 31 to vibrate and drives the screen 20 to vibrate to generate sound. As amplitude of the screen 20 during the sounding process is small, the design structure of the screen sounding device of the invention shall be applied in the corresponding mobile terminal to make the corresponding components of the mobile terminal slimmer and size of the assembled mobile terminal smaller. During the process of sounding, the iron core 321 can improve the magnetic effect. It is more helpful for magnetic conduction when the upper magnetic covering plate 323 and the lower magnetic covering plate 324 are used.

Figure 7:
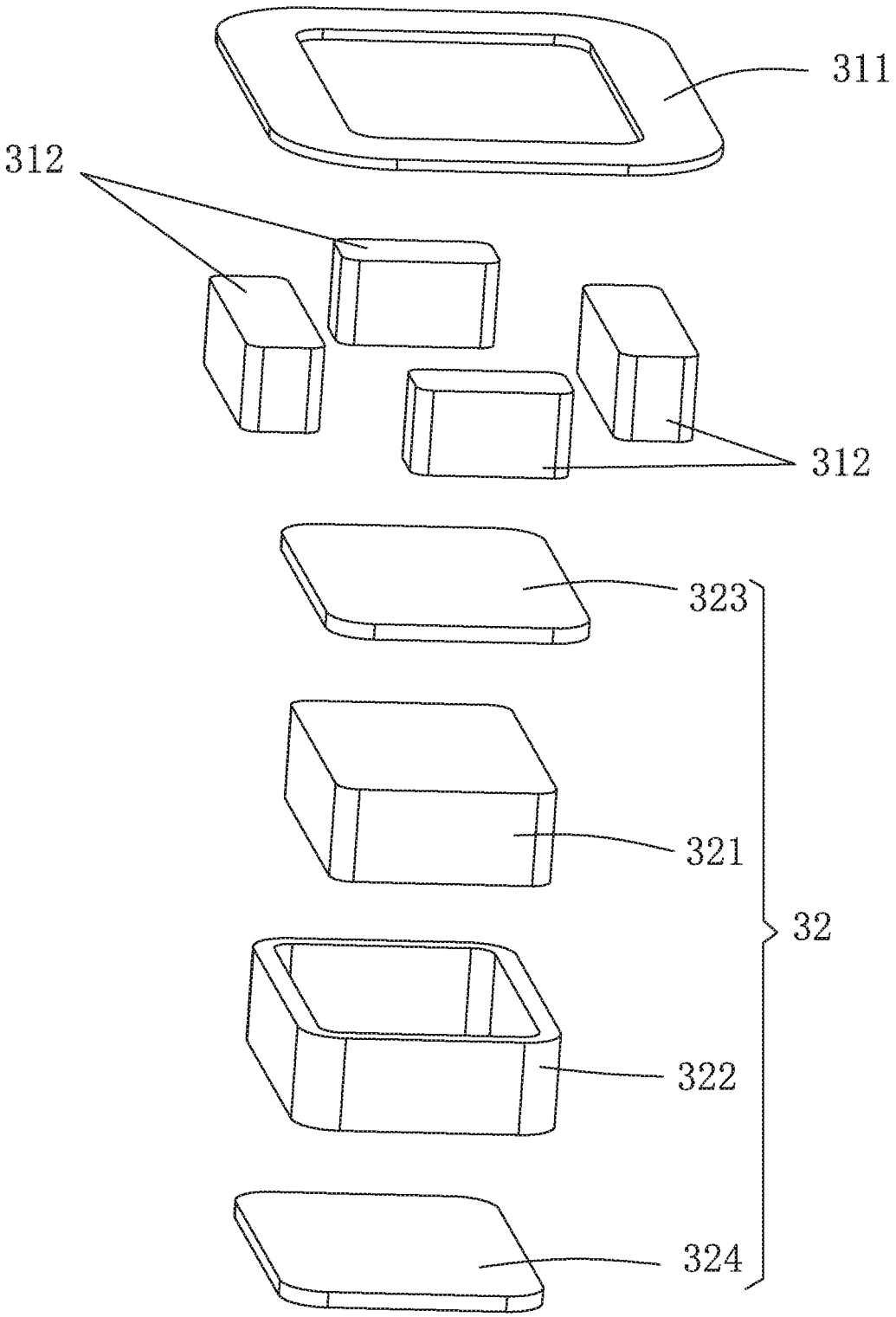
FIG. 7 is an exploded view of the driving device in FIG. 5.

In a first embodiment, shown as FIG. 7, the magnet 312 is multiple and the multiple magnets 312 are distributed evenly around the electromagnet. Specifically, the electromagnet 32 of the invention is square structure and therefore an amount of the magnet 312 is four. Each magnet 312 corresponds to one side surface of the electromagnet 32.

Figure 3:
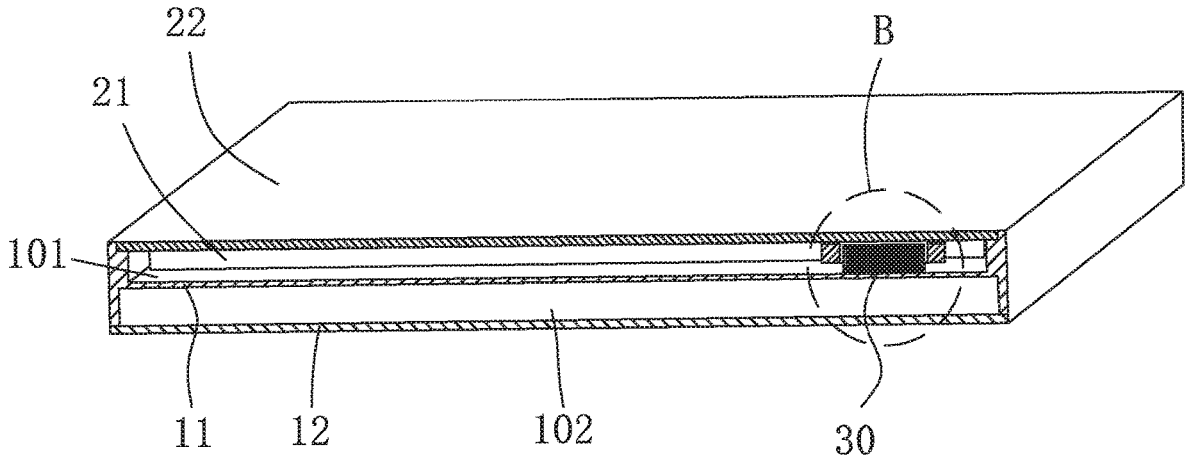
FIG. 3 is a cross-sectional view of the screen sounding device taken along line A-A in FIG. 1.
Figure 4:
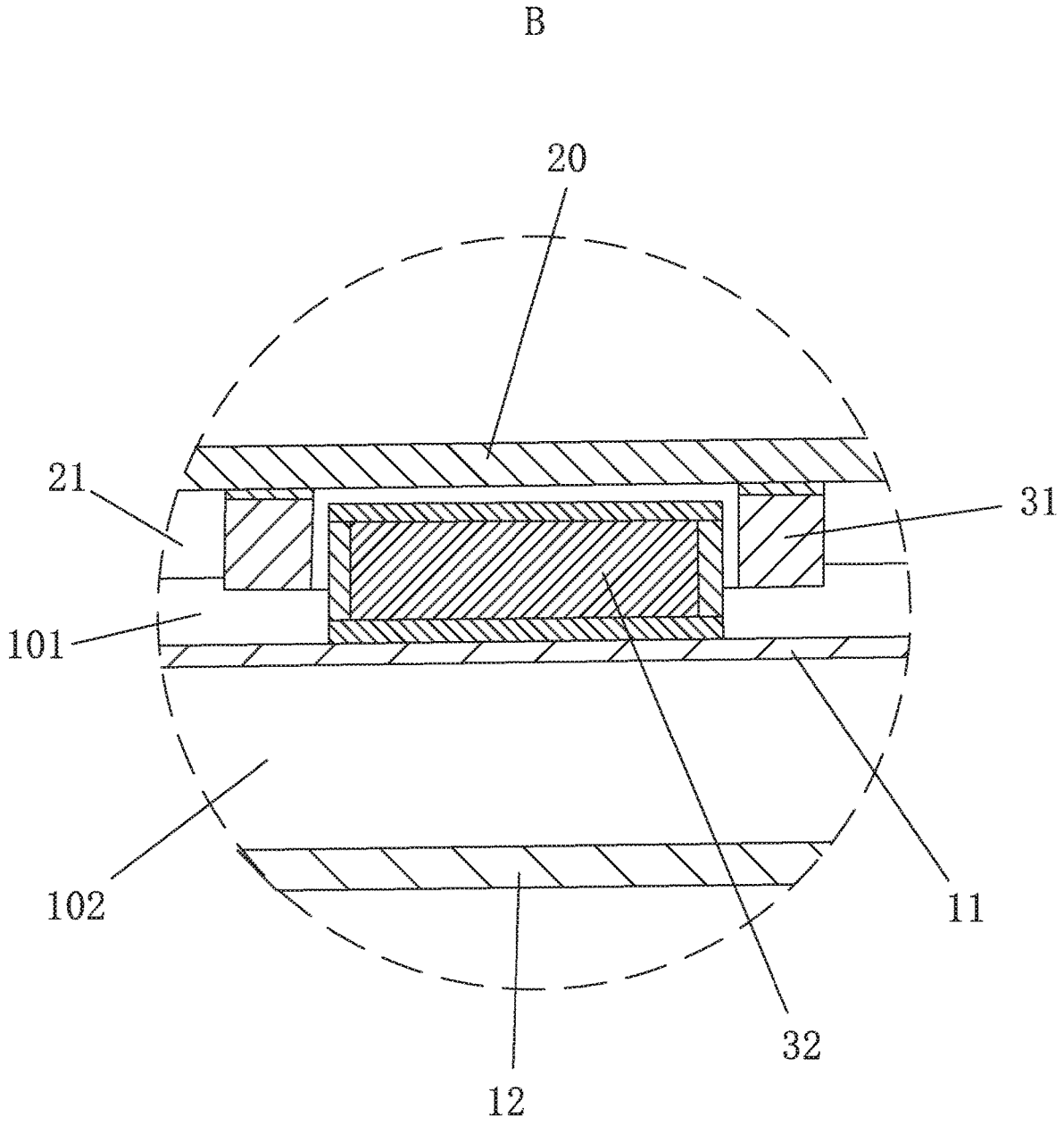
FIG. 4 is an enlarged view of Part B in FIG. 3.
Figure 5:
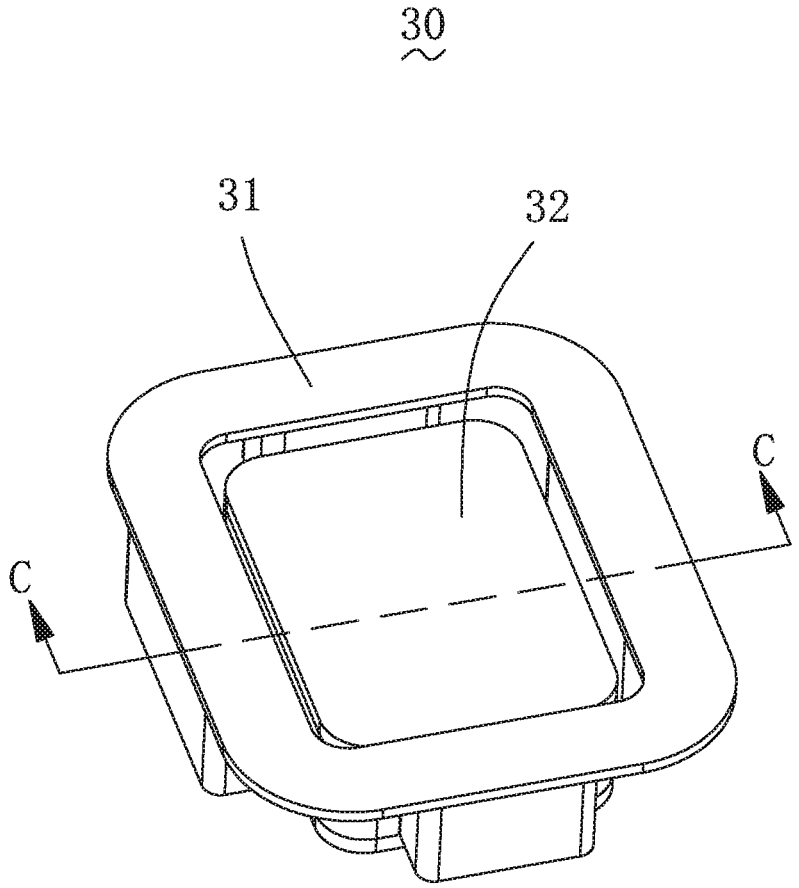
FIG. 5 is an isometric view of a driving device of the screen sounding device.
Figure 6:
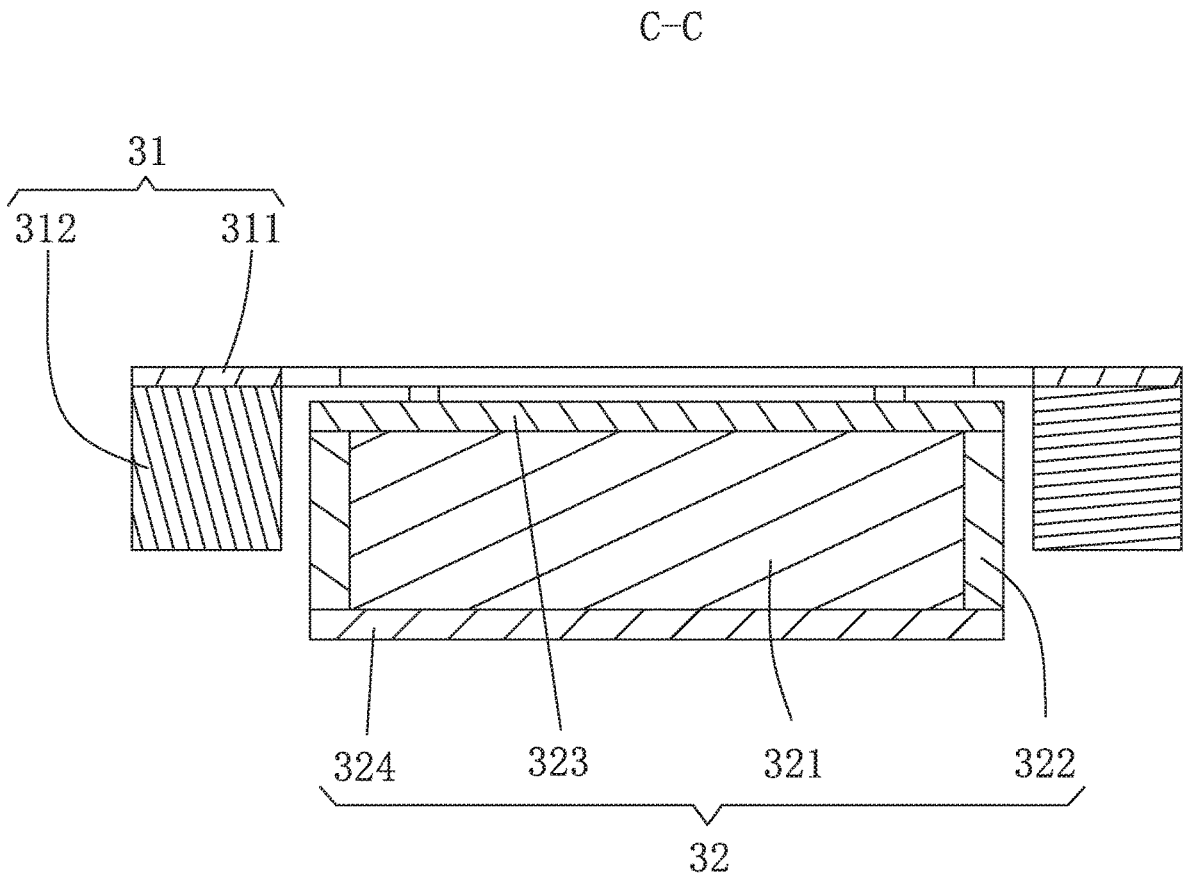
FIG. 6 is a cross-sectional view of the driving device taken along line C-C in FIG. 5.

As shown in FIG. 3, each magnet 312 is magnetized along a vibration direction of the screen 20. In fact, the screen 20 vibrates up and down in a vertical direction, and then the magnet 312 magnetizes along the vertical direction.

In the first embodiment, in order to reduce the used material of the connection covering plate 311, the connection covering plate 311 is circular plate and has through-hole circular plate corresponding with the electromagnet 32, and the connection covering plate 311 is made by magnetic conduction material. Therefore, the connection covering plate 311 can assist on magnetic conduction role of the magnet 312 to enhance the magnetic conduction role of the magnet 312 for generating greater driving force and better sound performance.

The frame 10 in the first embodiment includes a middle frame 11 and a rear covering plate 12 covered on the middle frame 11 on a opposite side of the screen 20. The screen 20 and the rear covering plate 12 form a first accommodation cavity 101 and a second accommodation cavity 102 respectively with the middle frame 11. The driving device 30 is accommodated in the first accommodation cavity 101 and the electromagnet 32 is fixed on the middle frame 11. The screen sounding device further includes a circuit main board 40 assembled inside the accommodation cavity 102 and connecting with the screen 20 electrically. The circuit main board 40 connects with the coil 322 of the electromagnet 32 electrically, wherein, the magnetic circuit system 31 and the electromagnet 32 are assembled inside the accommodation cavity 101. The screen 20 includes a display screen 21 and a glass panel 22 stacked layer by layer, and the display screen 21 is accommodated inside the accommodation cavity 101. The display screen 21 connects with the circuit main board 40 electrically by connecting cable. An edge of the glass panel 22 is fixed to a corresponding edge of the middle frame 11. The display screen 21 is attached to the glass panel 22.

Figure 8:
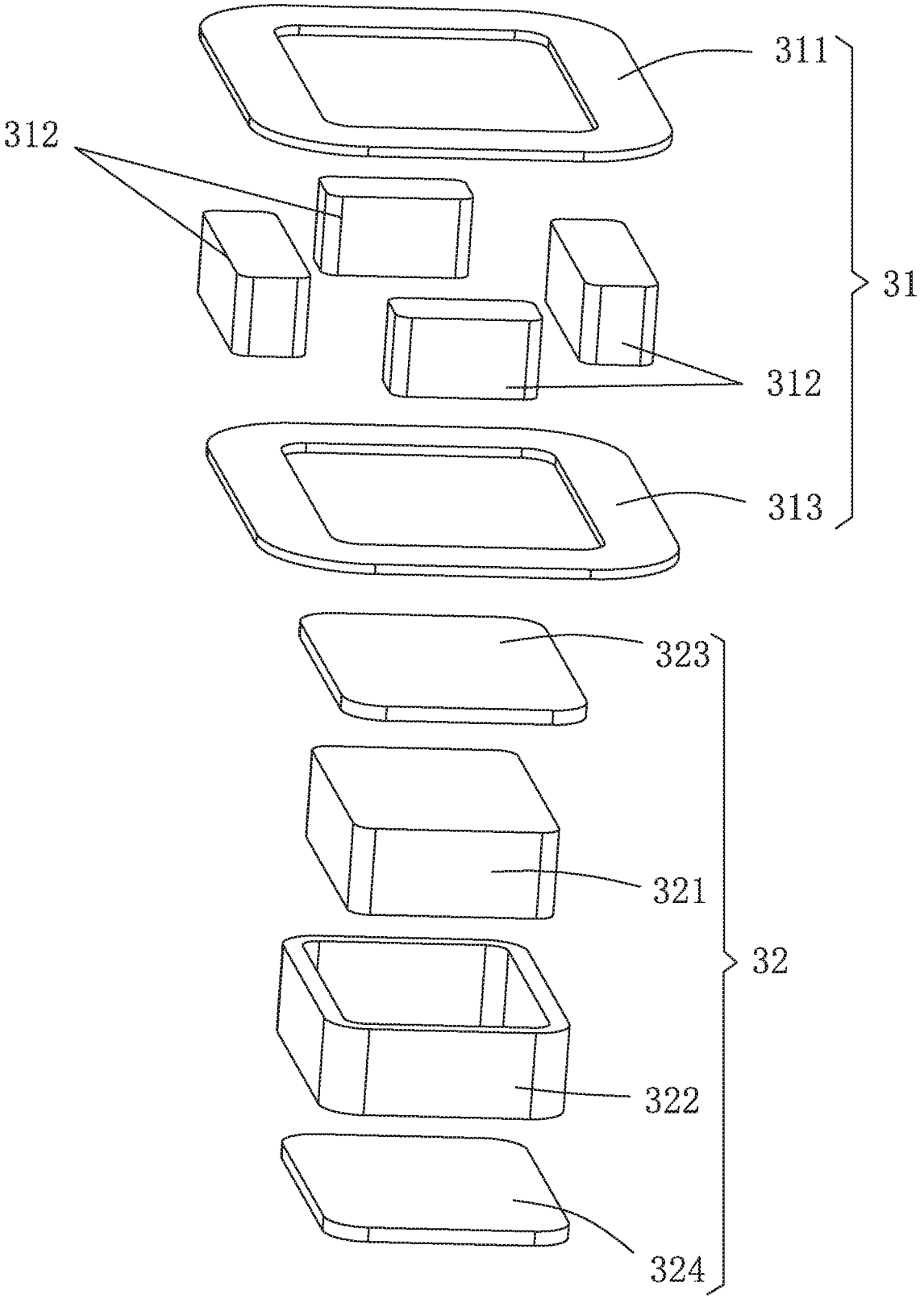
FIG. 8 is an exploded view of a driving device of a second embodiment of the invention.

Shown as FIG. 8, comparing with the structure of the screen sounding device of the first embodiment, the structure of the screen sounding device of the second embodiment has the following differences: the magnetic circuit system 31 further includes a magnet conduction plate 313 connected in one side of a magnet 312 away from the screen 20. The magnet conduction plate 313 and the connection covering plate 311 can be made of by the same magnetic conduction material. During the process of sounding, the magnet conduction plate 313 can enhance magnetic conductivity to obtain stronger driving force and better sound performance.

The rest structure of the screen sounding device of the second embodiment is the same as the corresponding structure of the first embodiment.

Figure 9:
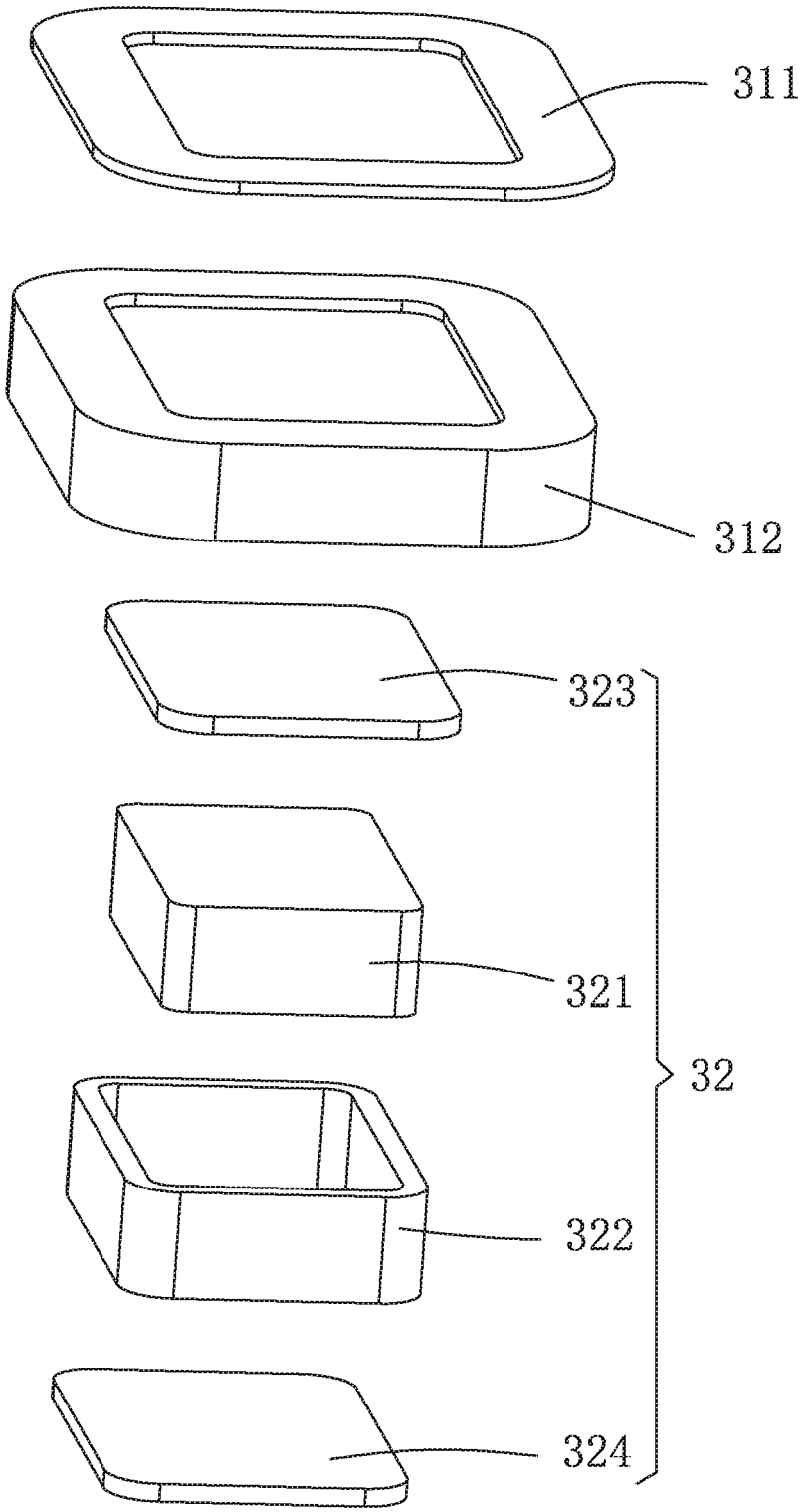
FIG. 9 is an exploded view of a driving device of a third embodiment of the invention.

Shown as FIG. 9, comparing with the structure of the screen sounding device of the first embodiment, the structure of the screen sounding device of the third embodiment has the following differences: the magnet 312 is integrated ring member, the electromagnet 32 is inserted into a through hole of the magnet 312. The rest structure of the screen sounding device of the third embodiment is the same as the corresponding structures of the first and second embodiments.

Figure 10:
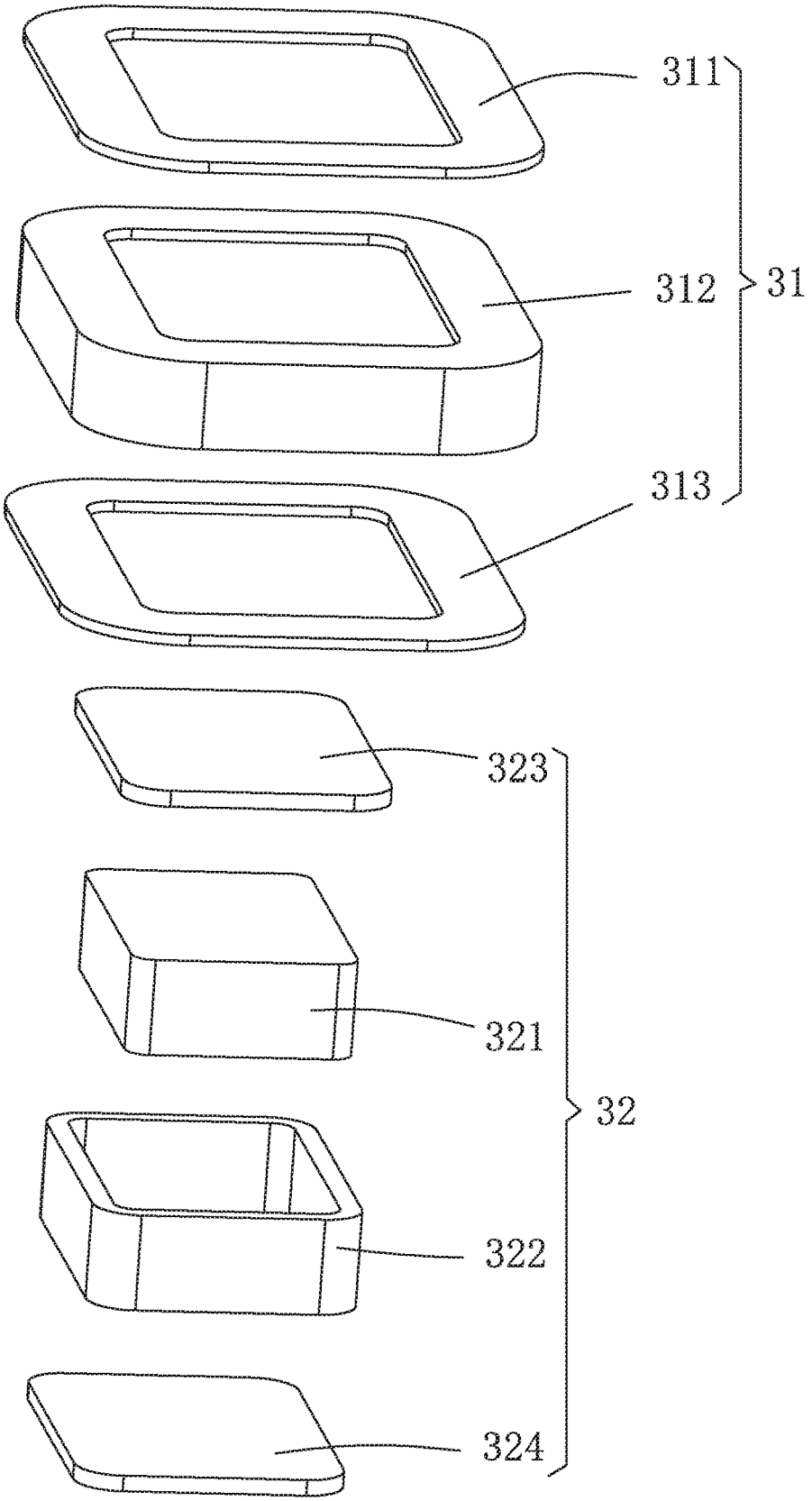
FIG. 10 is an exploded view of a driving device of a fourth embodiment of the invention.

Shown as FIG. 10, comparing with the structure of the screen sounding device of the second embodiment, the structure of the screen sounding device of the third embodiment has the following differences: the magnet 312 is integrated ring member and the electromagnet 32 inserted into a through hole of the magnet 312. The rest structure of the screen sounding device of the fourth embodiment is the same as the corresponding structure of the second embodiment.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A screen sounding device, including:

a frame;

a screen installed on the frame;

a driving device arranged between the frame and the screen for driving the screen to generate sound, including a magnetic circuit system fixed on the screen and an electromagnet for driving the magnetic circuit system; wherein the magnetic circuit system includes a connection covering plate fixed on the screen and a magnet fixed on a side of the connection covering plate away from one of the screen, and the magnet is arranged around the electromagnet, wherein the frame includes a middle frame and a rear covering plate covered on a side of the middle frame opposite to the screen; the screen and the rear covering plate form a first accommodation cavity and a second accommodation cavity separately with the middle frame; the driving device is accommodated inside the first accommodation cavity and the electromagnet is fixed with the middle frame.

2. The screen sounding device as described in claim 1, wherein the electromagnet includes an iron core, a coil wound around the iron core, an upper magnetic covering plate arranged on a side of the iron core close to the screen, and a lower magnetic covering plate arranged on a side of the iron core away from the screen; the lower magnetic covering plate is fixed on the frame.

3. The screen sounding device as described in claim 1 including a plurality of magnets distributed evenly around the electromagnet.

4. The screen sounding device as described in claim 1, wherein the magnet is an integrally-made ring.

5. The screen sounding device as described in claim 1, wherein the magnet is magnetized along a vibration direction of the screen.

6. The screen sounding device as described in claim 1, wherein the magnetic circuit system further includes a magnet conduction plate connected on one side of the magnet away from the screen.

7. The screen sounding device as described in claim 1, wherein the connection covering plate is made by magnetic conduction material.

* * * * *